US007318568B2

(12) United States Patent
Barouta

(10) Patent No.: US 7,318,568 B2
(45) Date of Patent: Jan. 15, 2008

(54) DEVICE FOR RELEASABLE MOUNTING OF A BUNDLE OF BAGS ON A WALL

(76) Inventor: Tony Barouta, Sidensvansvagen 42, 192 55 Sollentuna (SE)

( * ) Notice: Subject to any disclaimer, the term of this patent is extended or adjusted under 35 U.S.C. 154(b) by 0 days.

(21) Appl. No.: 10/565,292

(22) PCT Filed: Aug. 6, 2004

(86) PCT No.: PCT/SE2004/001168

§ 371 (c)(1),
(2), (4) Date: Jan. 20, 2006

(87) PCT Pub. No.: WO2005/014413

PCT Pub. Date: Feb. 17, 2005

(65) Prior Publication Data

US 2006/0226304 A1 Oct. 12, 2006

(30) Foreign Application Priority Data

Aug. 8, 2003 (SE) ..... 0302183

(51) Int. Cl.
*B65B 67/12* (2006.01)

(52) U.S. Cl. ..... 248/95; 248/98; 248/220.21; 248/220.22; 248/224.8; 248/225.21; 248/301; 248/305; 248/316.7; 383/23; 383/37; 206/554; 211/85.15; 211/49.1; 221/45; 221/282; 221/283; 40/641

(58) Field of Classification Search ..... 248/95, 248/98, 220.21, 220.22, 224.8, 225.21, 301, 248/305, 316.7; 383/23, 37; 206/554; 211/85.15, 211/49.1; 221/45, 282, 283
See application file for complete search history.

(56) References Cited

U.S. PATENT DOCUMENTS

| | | | | | |
|---|---|---|---|---|---|
| 1,722,551 | A | * | 7/1929 | Zadek | 24/710.3 |
| 1,866,691 | A | * | 7/1932 | Worley, Jr. et al. | 24/10.5 |
| 3,181,827 | A | * | 5/1965 | Sassin | 248/74.2 |
| 3,591,013 | A | * | 7/1971 | Von Herrmann | 211/50 |
| 3,753,305 | A | * | 8/1973 | Mueh | 40/649 |
| 4,300,692 | A | * | 11/1981 | Moreno | 211/87.01 |
| 4,563,796 | A | * | 1/1986 | Kettlestrings | 24/563 |
| 4,655,423 | A | * | 4/1987 | Schavilje et al. | 248/71 |
| 4,674,637 | A | * | 6/1987 | Lovelock et al. | 211/46 |
| 4,716,669 | A | * | 1/1988 | Fast | 40/650 |
| 4,932,560 | A | * | 6/1990 | Roen | 221/26 |
| 5,141,192 | A | * | 8/1992 | Adams | 248/231.81 |
| D330,850 | S | * | 11/1992 | Roick | D8/367 |

(Continued)

*Primary Examiner*—Carl D. Friedman
*Assistant Examiner*—Nkeisha J. Dumas
(74) *Attorney, Agent, or Firm*—Rolf Fasth; Fasth Law Offices

(57) ABSTRACT

A device is for releasably mounting a bundle of bags on a wall. The device has a wall-mounted suspension fitting. One rear major surface of the bag bundle is connected to a sheet which is parallel with said bundle and which is adapted for releasably co-action with the fitting. The bags are releasably connected to said sheet at there respective opening regions. The sheet has an opening midway of its width and the fitting has upwardly directed clip-finger that includes in an upper portion of its side facing towards the wall a projection that can be received in the opening in the sheet. The projection has two vertically separated oblique surfaces which are mutually convergent in a direction towards said wall for co-action with the upper and lower edges of the sheet opening.

6 Claims, 2 Drawing Sheets

U.S. PATENT DOCUMENTS 5,226,676 A * 7/1993 Su ..... 281/45
5,251,766 A * 10/1993 Barry ..... 211/89.01
5,255,883 A * 10/1993 Greenfield et al. ..... 248/95
D348,485 S * 7/1994 Short ..... D19/90
5,639,049 A * 6/1997 Jennings et al. ..... 248/74.2
5,743,565 A * 4/1998 Zimmanck ..... 281/44
5,857,586 A * 1/1999 Scherr ..... 221/45
5,979,841 A * 11/1999 Piraneo et al. ..... 248/95
6,182,933 B1 * 2/2001 Rapp ..... 248/231.81
6,257,422 B1 * 7/2001 Rios ..... 211/45
6,264,035 B1 * 7/2001 Petrie ..... 206/554
6,273,374 B1 * 8/2001 Mc Duffey ..... 248/205.3
6,378,827 B1 * 4/2002 Kacines ..... 248/231.81
6,389,723 B1 * 5/2002 Rink, Jr. ..... 40/642.02
6,508,381 B1 * 1/2003 Sadi ..... 221/45
D471,081 S * 3/2003 Wu et al. ..... D8/356
D477,773 S * 7/2003 Gary et al. ..... D8/395
6,644,836 B1 * 11/2003 Adams ..... 362/396
6,648,171 B2 * 11/2003 Rink, Jr. ..... 221/26
6,772,909 B2 * 8/2004 Bateman ..... 221/305
2002/0134702 A1 * 9/2002 DeSmedt et al. ..... 206/554
2006/0266900 A1 * 11/2006 May et al. ..... 248/220.22

* cited by examiner

DEVICE FOR RELEASABLE MOUNTING OF A BUNDLE OF BAGS ON A WALL

PRIOR APPLICATION

This application is a U.S. national phase application based on International Application No. PCT/SE2004/001168, filed 6 Aug. 2004, claiming priority from Swedish Patent Application No. 03021839, filed 8 Aug. 2003.

The present invention relates to a device of the kind defined in the preamble of the accompanying claim 1, for the releasably mounting of a bundle of bags on a wall surface.

The availability of so-called bag bundles that comprise a stack of flat, similarly orientated bags and a cardboard sheet on the rear side of the stack is known in practice. The bundle is conveniently held together with the aid of staples that pass through the upper edge region of the bundle, i.e. through an upper edge region of respective bags.

One front side of respective bags facing away from the cardboard sheet includes a slit or a tear line along which said front side of the bag can be opened while the opposite rear side of the bag is connected to the aforementioned upper edge region of the bag such as to enable an exposed, filled bag to be supported by the upper edge portion of the cardboard sheet on the one hand and to enable the bag to be released from said cardboard sheet on the other hand. This enables the rear side of the bag to be connected to the upper edge region of the bundle, i.e. to enable the upper edge region of a respective bag to be connected to the upper edge region of the bundle through the medium of a tear line or weakening line that permits controlled separation of respective bags from said upper edge region.

The devices known in practice include a suspension fitting in the form of a generally U-shaped element whose legs have a length that generally corresponds to the thickness of the cardboard sheet and are horizontally spaced apart by a distance corresponding to the width of said bundle, wherein the legs of the element are connected to a vertical wall surface. As a result of the vertical wall surface, there is established between the element and the wall surface a slot through which the cardboard sheet can be conveniently lowered and supported vertically by said wall surface such as to stabilize the bag bundle. Because the cardboard sheet is connected to the upper edge region of the bundle, the sheet will have a relatively large vertical extension thereby reducing the risk of the bundle being shaken loose from the suspension fitting.

A device of this kind finds particular use in transport vehicles, such as trains, aircraft, buses and cars. However, one problem is that such vehicles often lack vertical flat surfaces of a size that corresponds to the size of the bundle at those places in the vehicle in which it is desired to mount such devices.

Accordingly, one object of the invention is to provide a device of the aforesaid kind that will enable bundles of bags to be hung conveniently on wall surfaces that are horizontal and/or that are curved vertically and that will afford releasably mounting of a bag bundle on its suspension fitting in a favorable and secure fashion. In this regard, a further object is to provide a suspension fitting that can be connected securely to a small area of said wall surface, for instance with the aid of double-sided adhesive tape or the like.

These objects are achieved with the present invention.

The invention is defined in the accompanying claim 1.

Other embodiments of the present invention will be evident from the dependent claims.

An important feature of the present invention is that the cardboard sheet includes an opening and that the suspension fitting has a clip-finger that includes a projection which fits into said opening. In one particularly preferred embodiment of the invention, the width of the opening in the cardboard sheet corresponds to only a fraction of the width of the sheet/bundle, for instance about a quarter of the width of said bundle. The fitting may generally have the form of an upwardly open spring clip whose one leg is connected to the wall while the other leg of which carries on its inner surface the aforesaid projection that fits into the opening in the cardboard sheet. In its operative state, the projection functions to contact both the upper and the lower edge of the opening, such as to secure the cardboard sheet stably in a vertical direction. The fitting may be given a small size, i.e. may be given a height and a width that correspond solely to a fraction of the respective height and width of the bundle, and thereby enable the fitting to be readily fastened with the aid of pieces of double-sided adhesive tape that are spaced at a relatively small distance apart on the suspension legs of the clip.

The invention will now be described in more detail with reference to an exemplifying embodiment thereof illustrated in the accompanying drawing.

Figure 1:
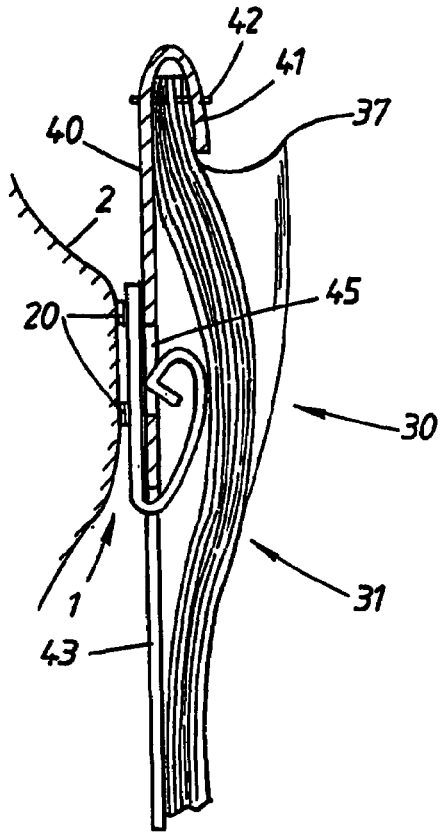
FIG. 1 is a diagrammatic vertically sectioned view of a device according to the present invention.
Figure 2:
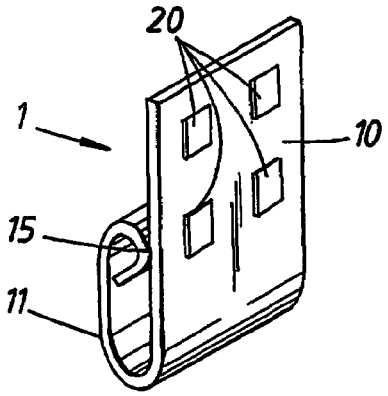
FIGS. 2 and 3 are perspective views of a bag bundle suspension fitting.
Figure 3:
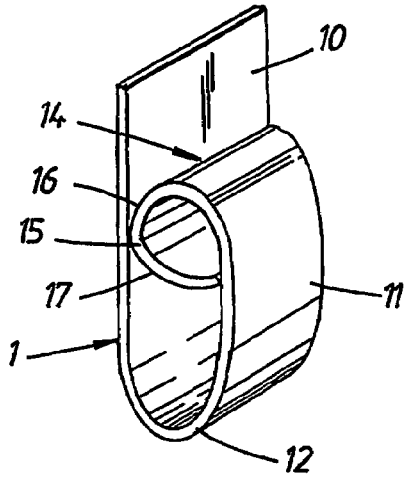

FIGS. 2 and 3 illustrate a suspension fitting in the form of a strip-like element that has a first leg 10 and a second leg 11, this latter leg 11 being connected to the first leg 10 by means of a so-called web 12. The free end portion 14 of the leg 11 is curved inwards towards the leg 10 through an angle of slightly more than 180 degrees such as to obtain the form of a nose 15 which is delimited by two mutually converging surfaces 16, 17. The nose 15 is preferably arranged to contact the web 10. The strip-element is comprised of a springy, elastic material. The leg 10 is shown to carry on its rear side small discrete pieces 20 of double-side adhesive tape with which the fitting 1 can be mounted on a wall surface 2, for instance a wall surface in a transport vehicle, said fitting 1 being mounted with the legs 10, 11 directed upwards.

Figure 4:
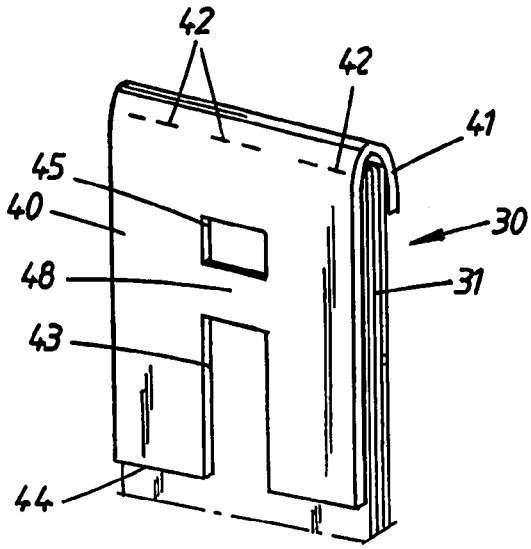
FIG. 4 is a perspective view of the rear side of a bag bundle.

The bag bundle 30 illustrated in FIG. 4 includes a stack 31 of bags 32 which are placed flat against one another and similarly orientated. (FIG. 5).

Each bag 32 has a rear wall 33 and a front wall 34. The upper edge of the rear wall 33 connects with an end section 36 via a tear line or weakening 35.

The upper edge 37 of the front bag wall 34 is shown separated from an edge section 38, so as to enable the outermost bag in the stack 31 to be readily opened out. It will, however, be understood that the bag wall 34 may be connected to the edge section 38 through the agency of a weak tear line that enables a user to easily tear open the bag.

Figure 5:
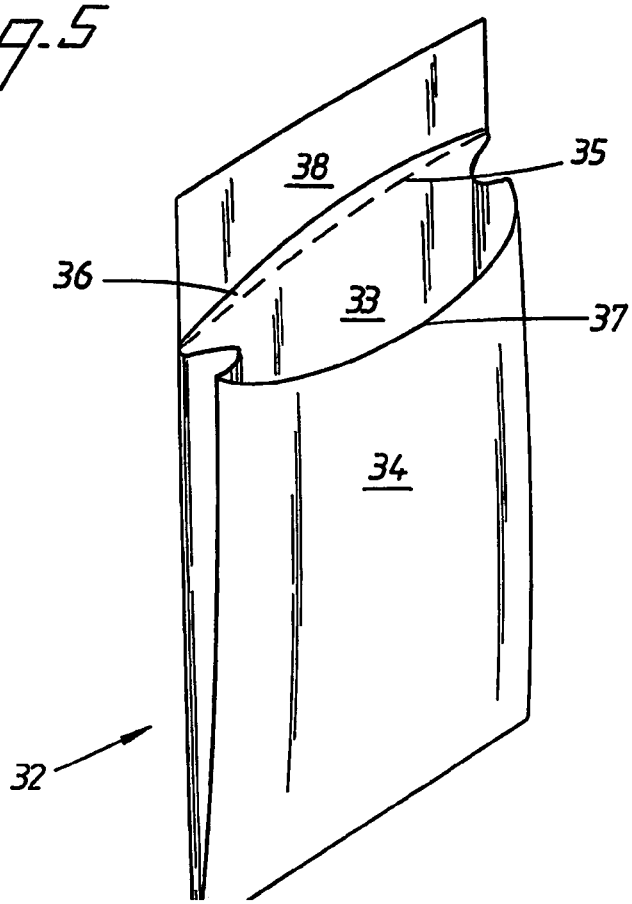
FIG. 5 illustrates a single bag of a bag bundle.

As shown in FIG. 5, the bag may also include side-folds between the front wall 34 and the rear wall 33.

The stack of bags 31 is mounted on a cardboard or paperboard sheet 40, which will preferably cover substantially the entire rear side of the stack 31 and that has generally the same format as said stack. The cardboard sheet 40 has an upper, folded edge region 41 that extends in over the upper edge portions 36, 38 of the bags. Staples 42 extend through the folded upper edge part of the cardboard sheet 40 and through the stack 31.

The cardboard sheet 40 includes midway of its width a slot 43 which extends upwardly from the lower edge 44 of said sheet 40. A generally rectangular opening 45 is provided above the bottom of the slot 43 and positioned generally in alignment with said slot. The width of the opening 45 and the width of the slot 43 correspond to the width of the strip-like suspension fitting 1.

It will be evident that the fitting 1 can be mounted readily to a wall surface 2 of a transport vehicle and that the cardboard sheet 40 can be readily threaded down with the slot 43 positioned over the fitting 1, until the portion 48 of the cardboard sheet located between the bottom of slot 43 and the opening 45 penetrates through the nip defined between the nose 15 of the fitting 1 and the leg 10. The oblique surfaces 16 and 17 facilitate insertion and removal of the part 48 of the cardboard sheet into and out of the closed part of the fitting 1 and counteract accidental or unintentional removal of the bag bundle from the fitting 1. The presence of the slot 43 enables the fitting 1 to be given a small height between the nose 15 and the web 12.

While the present invention has been described in accordance with preferred compositions and embodiments, it is to be understood that certain substitutions and alterations may be made thereto without departing from the spirit and scope of the following claims.

The invention claimed is:

1. A device for releasably mounting a bundle of bags on a wall, the device comprising:

a sheet having an opening defined therein, the sheet having a slot defined therein, the slot being disposed below the opening;

a bundle of bags removably attached to the sheet, the bundle of bags being parallel to the sheet;

a wall-mounted suspension fitting, the fitting having a first leg terminating at a curved bottom web, the curved bottom web extending to a second leg, the second leg having a free end portion, the free end portion being curved inwardly towards the first leg, the free end portion having a first converging surface and a second converging surface forming a nose;

the curved bottom web being disposed in the slot of the sheet, the nose extending through the opening of the web and bearing against the first leg; and the second leg being in contact with the bundle of bags and urging the bundle of bags away from the sheet.

2. A device according to claim 1, wherein the slot extends upwardly from a lower edge of the sheet.

3. A device according to claim 1, wherein the first leg is connectable to a wall.

4. A device according to claim 3, wherein the fitting is comprised of a springy, elastic strip-like element.

5. A device according to claim 3, wherein the first leg has adhesive pads.

6. A device according to claim 4, wherein the free end of the second leg is curved downwardly towards the curved bottom web.

* * * * *